United States Patent [19]

Burton

[11] 4,224,886

[45] Sep. 30, 1980

[54] CUTTING AND HEMMING SYSTEM

[75] Inventor: Perry E. Burton, Atlanta, Ga.

[73] Assignee: Opelika Manufacturing Corp., Chicago, Ill.

[21] Appl. No.: 21,794

[22] Filed: Mar. 19, 1979

Related U.S. Application Data

[62] Division of Ser. No. 799,286, May 23, 1977, Pat. No. 4,154,180.

[51] Int. Cl.[3] ..... D05B 21/00

[52] U.S. Cl. ..... 112/121.15

[58] Field of Search ..... 112/121.15, 121.11, 112/121.12, 121.29, 130, 141, 304, 303, 262.3; 271/225, 186

[56] References Cited

U.S. PATENT DOCUMENTS

| | | | |
|---|---|---|---|
| 1,469,168 | 9/1923 | Mets | 271/186 X |
| 2,823,788 | 2/1958 | Chase | 271/225 X |
| 3,580,198 | 5/1971 | Teed et al. | 112/121.11 |
| 3,640,235 | 2/1972 | Burton | 112/121.29 |
| 3,772,948 | 11/1973 | Burton | 112/121.29 X |
| 3,773,002 | 11/1973 | Burton | 112/121.29 X |
| 3,955,515 | 5/1976 | Burton | 112/121.15 |

FOREIGN PATENT DOCUMENTS

| | | | |
|---|---|---|---|
| 2529103 | 1/1977 | Fed. Rep. of Germany | 271/186 |

*Primary Examiner*—H. Hampton Hunter

*Attorney, Agent, or Firm*—Jones, Thomas & Askew

[57] ABSTRACT

Cloth moves from a reel along its length, a first "right-handed" edge treatment system positioned at one edge of the path of movement of the cloth treats one edge of the cloth, the cloth is turned over and a second "right-handed" edge treatment system positioned at the edge of the path of movement treats the opposite edge of the cloth. The cloth then moves into a cutting station where the cloth is cut into smaller sections. The cut sections are moved along an L-shaped path by a conveyor system with the cut edges extending along the path, and a third "right-handed" edge treatment system positioned adjacent the first leg of the L-shaped path treats one cut edge of the sections, the sections are turned over as they move into the second leg of the L-shaped path, and a fourth "right-handed" edge treatment system treats the opposite cut edge of the sections. The sections are then stacked.

4 Claims, 8 Drawing Figures

CUTTING AND HEMMING SYSTEM

This is a division of application Ser. No. 799,286, filed May 23, 1977, now U.S. Pat. No. 4,154,180 dated May 19, 1979.

BACKGROUND OF THE INVENTION

In the manufacture of cloth products, such as napkins and washcloths that include folded hems, the products are usually manufactured by cutting a long length of cloth in smaller sections, and a sewing machine operator folds the edges over to form hems and sews around the four sides of the product. This prevents the hem from raveling and forms an attractive edge on the product.

Although many attempts have been made in an effort to automatically form hems in cloth lengths, only a few attempts have been considered commercially successful, and most of the attempts have failed where relatively small hems are to be formed in relatively bulky materials, such as the typically small hems in washcloths, towels and other objects fabricated from similar materials. As the hems get smaller and the thickness of the material increases, it is more difficult to automatically form the hem.

As illustrated in U.S. Pat. Nos. 3,640,235, 3,773,002, 3,722,435 and 3,580,198, various attempts have been made to automatically hem the edges of cloth sections. For example, U.S. Pat. No. 3,580,198 discloses a system which hems the opposite edges of a continuous length of cloth, cuts the length into sections, turns the length 90° as it continues to move in its rectilinear path, and then hems the opposite cut edges of the sections. U.S. Pat. Nos. 3,640,235 and 3,772,948 disclose systems which cut cloth sections from a continuous length of cloth, moves the cut lengths at a right angle with the cut edges parallel to the path of movement, hems one cut edge, and then flips the other cut edge over so that it can be hemmed by another "right-handed" sewing machine. U.S. Pat. No. 3,722,435 also discloses a right angle system but which utilizes a turning drum and conveyor tapes for turning the cloth sections over so that "right-handed" sewing machines can be used to hem the opposite cut edges of the cloth sections.

In addition to the cloth handling and guidance systems described in the preceding patents, various attempts have been made to control the movement of a folded hem and the body of a cloth section as the edge portion of the cloth section is folded over and sewn closed. For example, U.S. Pat. No. 3,906,878 discloses a system in which a double fold is formed in the edge portion of a cloth section and the velocity of the folded portion as it approaches the sewing machine is controlled so as to prevent a "dog ear" or "hangout" from occurring in the hem of the cloth section.

SUMMARY OF THE INVENTION

Briefly described, the present invention comprises a cutting and hemming system that functions automatically, rapidly and accurately to form hemmed cloth sections from a length of cloth. Cloth is moved from a supply along its length through a feed system in the first leg of a U-shaped path, the cloth is turned over in the first leg of the U-shaped path, and a pair of "right-handed" edge treatment systems finish the opposite edges of the cloth before and after the cloth is turned over. The cloth is next guided to a cutting station where it is cut into sections. The sections are moved in sequence at a right angle from the first leg of the U-shaped path along the second leg of the U-shaped path with the cut edges of the sections extending along their direction of movement, and a third "right-handed" edge treatment system finishes one of the cut edges of each cloth section. The cloth sections are then turned over and moved at a right angle along the third leg of the U-shaped path with the unfinished cut edge of each section extending along the direction of movement where a fourth "right-handed" edge treatment system finishes the other cut edge of each cloth section. A stacker grasps the opposite edges of the cloth sections as they move off the last leg of the U-shaped path, moves each section to a stacking area and releases the opposite edges so that the now-finished cloth sections are stacked.

The edge treatment systems in the disclosed embodiment of the invention comprise folders and sewing machines which function to fold the edge portions of the cloth over and sew the fold closed. A control system is used in conjunction with the third and fourth sewing machines so as to retard the movement of the cloth sections as the trailing edges of the cloth sections move into the high speed sewing machine, to prevent "hangout" or "dog ears" from being formed at the trailing edges of the hems in the cloth sections.

Thus, it is an object of this invention to provide a cutting and hemming system for forming cloth sections and the like which functions rapidly and accurately in a continuous process for forming cloth sections that are attractive to the retail customer.

Another object of this invention is to provide an automatic cutting and hemming system for forming hemmed lengths of material from a generally continuous source of material in a continuous, rapid process.

Another object of this invention is to provide an inexpensive, durable and versitle cutting and hemming system for rapidly and accurately cutting and hemming or otherwise treating the cut ends of lengths of material.

Other objects, features and advantages of the present invention will become apparent upon reading the following specification, when taken in conjunction with the accompanying drawing.

DETAILED DESCRIPTION

Figure 1:
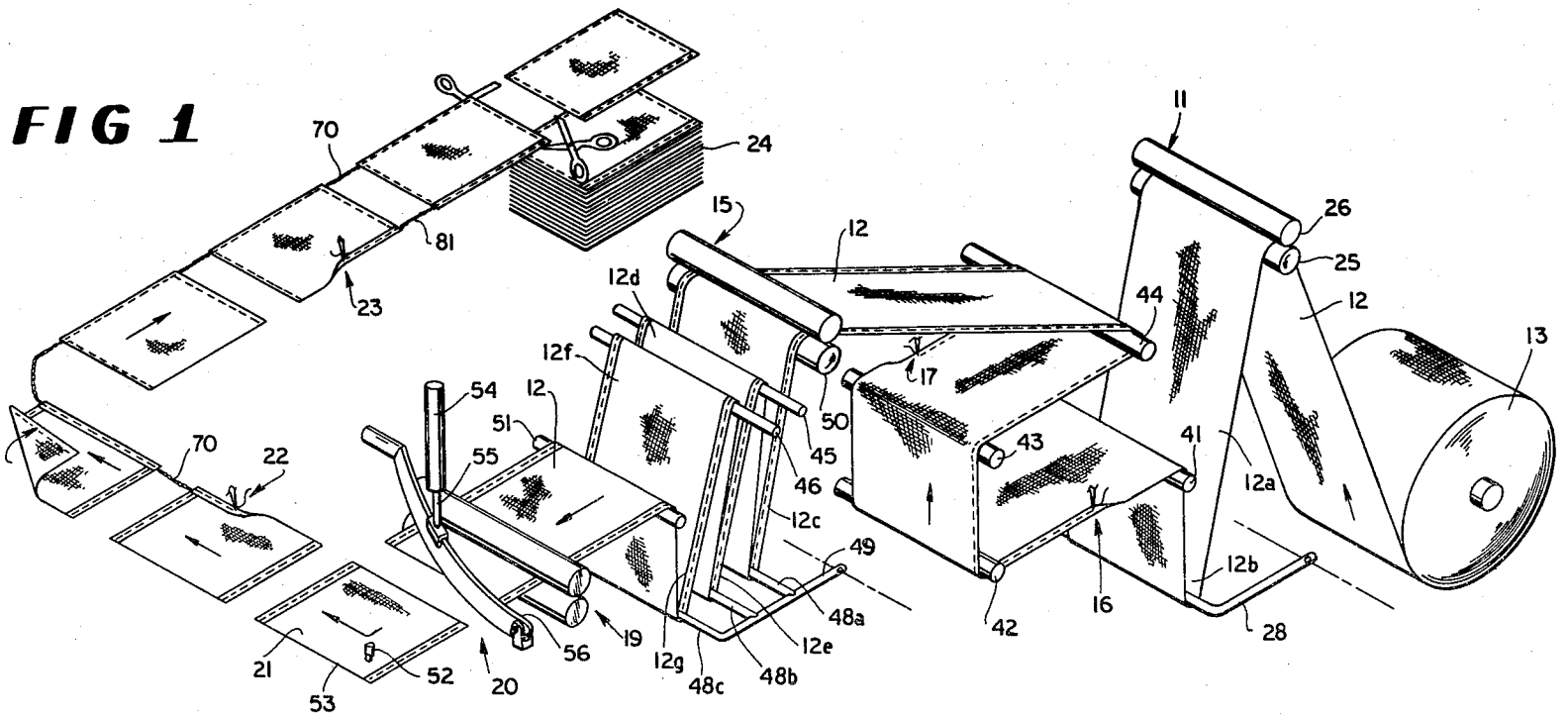
FIG. 1 is a schematic perspective illustration of the cutting and hemming system.

Referring now in more detail to the drawing, in which like numerals indicate like parts throughout the several views, FIG. 1 illustrates the cutting and hemming system 10 which includes first feed means 11 for pulling cloth 12 along its length from a supply such as reel 13. Second feed means 15 also receives the cloth 12 and pulls the cloth along its length through first and second edge treating stations 16 and 17. Third feed means 19 pulls the cloth from second feed means 15 into cutting station 20. The cloth is then cut into sections 21 and moved at a right angle with respect to its first direction of movement through the second leg of a U-shaped path through a third edge treating station 21, the cloth is then turned through a right angle into the third leg of the U-shaped path where it passes through the fourth edge treating station 23, and the cloth is subsequently stacked at 24.

The first feed means 11 comprises a driven roller 25 and an idler roller 26 and the cloth 12 is fed between the rollers. The cloth extends in a downward direction at 12*a* from feed means 11 through a loop 12*b* about the lower surface of loop control bar 28.

Figure 2:
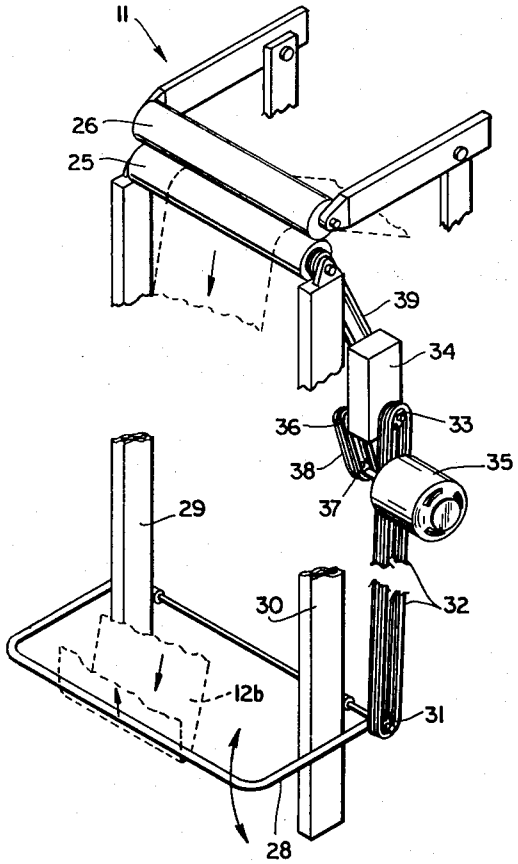
FIG. 2 is a perspective illustration, with parts broken away, of one of the feed systems.

As is illustrated in FIG. 2, loop control bar 28 is hingedly mounted to the back surfaces of upright support posts 29 and 30 and its weight tends to cause it to rest in the loop 12*b* of the cloth. Sprocket 31 rotates with loop control bar 28, and its chain 32 is connected to the sprocket 33 of variable speed transmission 34. Electric motor 35 drives the input sprocket 36 by means of its sprocket 37 and chain 38 of variable speed transmission 34, and the output sprocket (not shown) and chain 39 drive the driven roll 25 of the first feed means 11. When loop control bar 28 tilts in a downward direction because of an additional supply of cloth 12 in the loop 12*b*, its chain 32 will rotate the sprocket 33 in the variable speed transmission 34, causing the output chain 39 between the variable speed transmission 34 and the driven roller 35 to decrease in velocity, so that cloth is fed to the loop 12*b* at a slower rate. When the loop 12*b* decreases in depth and the loop control bar 28 tilts in an upward direction, the reverse function takes place, in that the variable speed transmission 34 will rotate the feed roll 25 at a faster rate.

The cloth 12 moves from loop 12*b* about a plurality of guide rolls 41, 42, 43 and 44. As the cloth moves from guide roll 41 toward guide roll 42, it moves through the first edge treatment station 16 where, for example, one edge of the cloth is folded into a hem and the hem is sewn closed by a right-handed sewing machine, or where other edge treatment functions take place. When the cloth moves from guide roll 43 to guide roll 44, it moves past the second edge treatment station 17, where the opposite side edge portion of the cloth is folded over and the fold is sewn closed by similar right-handed equipment. Thus, when the cloth passes about guide roll 44 to the second feed station 15, its opposite side edge portions are folded and sewn into a hem.

When the cloth 12 is fed from second feed means 15, it passes through a multiple number of loops 12*c*, 12*d*, 12*e*, 12*f* and 12*g* about stationary upper guide bars 45 and 46 and about movable lower guide bars 48*a*, 48*b* and 48*c*. The lower guide bars 48*a*, 48*b* and 48*c* form a part of a loop control grid 49 that is similar to the loop control system illustrated in FIG. 2, but which includes a multiple loop arrangement of the rods 48*a*, 48*b* and 48*c*. The upward and downward tilting of the loop control grid 49 controls the speed of rotation of the feed roller 50 of second feed means 15 in the manner illustrated in FIG. 2.

Third feed means 19 pulls the cloth 12 over the guide bar 51 into cutting station 20. A photoelectric cell 52 detects the oncoming edge 53 of the length of cloth and actuates double acting ram 54. The ramrod 55 oscillates the cutter 56 in response to the detection by the photoelectric cell 52 so as to cut the cloth into the sections 21.

Figure 3:
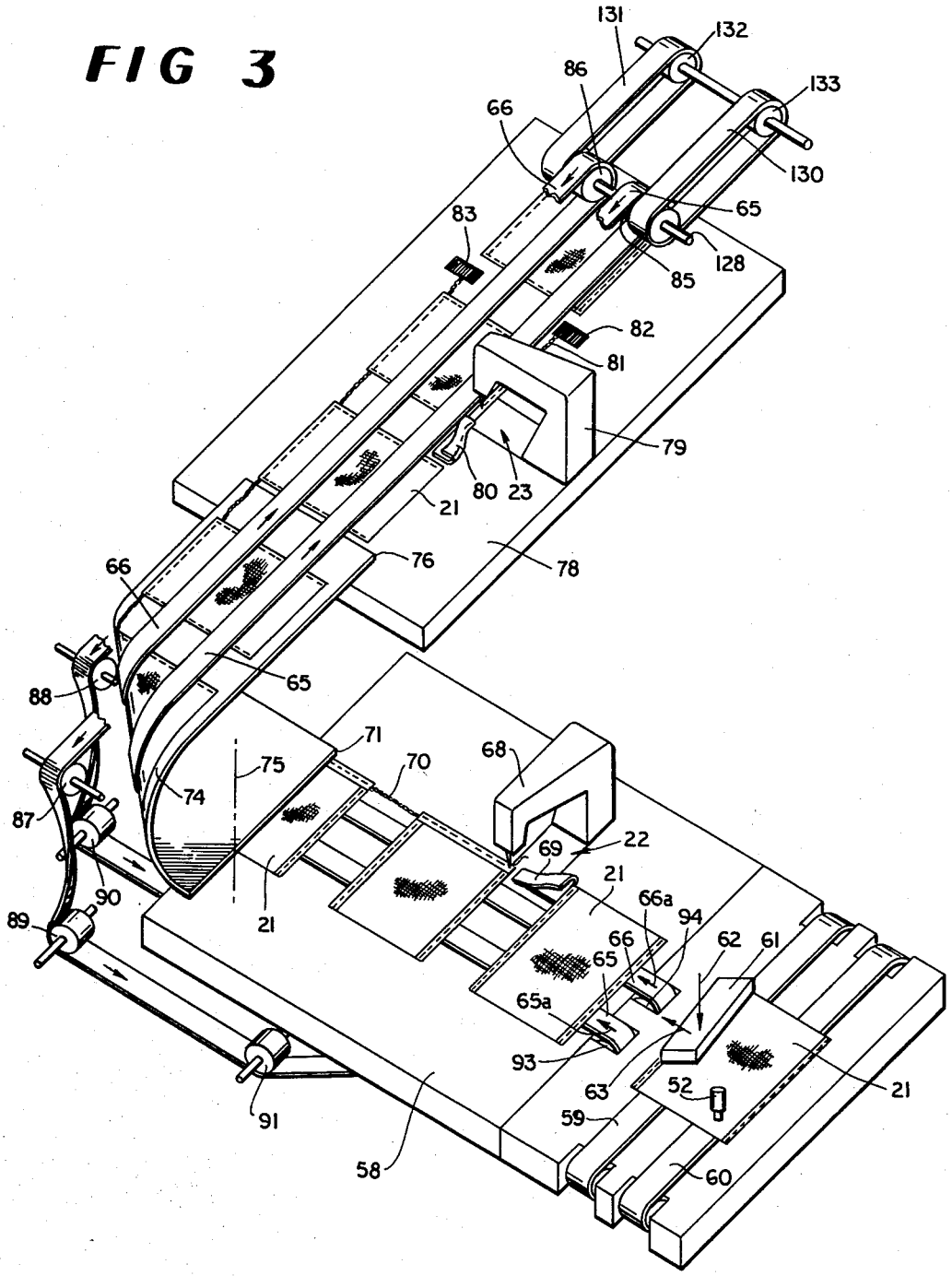
FIG. 3 is a perspective schematic illustration of the conveyor system and its associated components for the cutting and hemming system.

As illustrated in FIG. 3, a work table assembly 58 receives the cut cloth sections 21 from the cutting station 19, and a network of conveyor tapes moves the cloth sections on through the system. A first pair of conveyor tapes 59 and 60 carry the cloth from the cutting station on beyond the cutter 56 until the photoelectric cell 52 detects the leading edge of the cloth, whereupon the cutter 56 is actuated. The transfer head 61 also responds to the photoelectric cell 52 and moves first in a downward direction as indicated by arrow 62 to make contact with the cloth section on the work table, then in a horizontal direction 63 to transfer the cloth section to a second pair of conveyor tapes 65 and 66. After it has moved the cloth sections to the second pair of conveyor tapes, the head 61 retracts to its ready position.

Conveyor tapes 65 and 66 move the cloth sections 21 through an L-shaped path. A sewing machine 68 is located in the third edge treatment station 22 and a folder 69 is positioned just ahead of the needle of the sewing machine. Thus, the folder and sewing machine function as the third edge treatment system and fold over and sew through one cut edge portion of each cloth section 21. The sewing machine forms a chain link stitch 70 between adjacent ones of the cloth sections 21.

As the cloth sections 21 move off the first work table 58, each cloth section passes beneath the first edge 71 of a twisted sheet 72. Sheet 72 is an elongated rectangular sheet that is twisted at a right angle to form a convex surface 74 that has an elongated axis 75. The second edge 76 of the sheet 72 extends onto second work table 78. The longitudinal axis 75 of the convex surface 74 is formed at an approximately 45° angle with respect to the direction of movement 65*a* and 66*a* of the conveyor tapes 65 and 66, and the conveyor tapes move beneath the first edge 71 of the sheet 72 then about the angled convex surface 74, and then off the second edge 76 of the sheet and onto the second work table 78.

The conveyor tapes 65 and 66 move onto second work table 78 and carry the cloth sections 21 on through the fourth edge treatment station 23. Sewing machine 79 and edge folder 80 functions as edge treatment means for folding over the edge portion of each cloth section and sewing through the folded edge to form a finished hem. The sewing machine 79 also forms a chain link stitch 81 between the adjacent ones of the cloth sections. Thread cutters 82 and 83 are recessed in the second work table 78 and function to cut the chain link threads 70 and 81, so that each cloth section 21 emerges off the end of work table 78 as a separate product.

When the conveyor tapes 65 and 66 reach the end of second work table 78, they move upwardly and in a reverse direction about a pair of guide rollers 85 and 86 back over work table 78, then downwardly about another pair of guide rollers 87 and 88 adjacent the guide sheet 72, then about a third pair of guide rollers 89 and 90 horizontally then about a pair of tension rollers 91 (only one shown), and then about the work table guide rollers 93 and 94. Driving rollers (not shown) are located beneath work table 58 and function to drive the conveyor tapes 65 and 66.

Figure 6B:
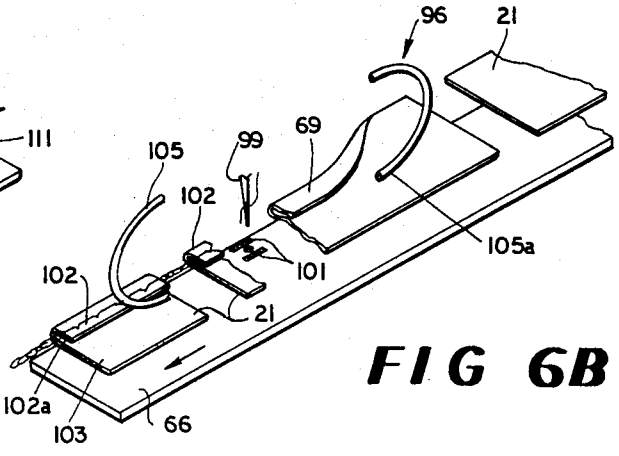
FIGS. 6A and 6B are schematic perspective illustrations of the control system for the third and fourth sewing machines.
Figure 6A:
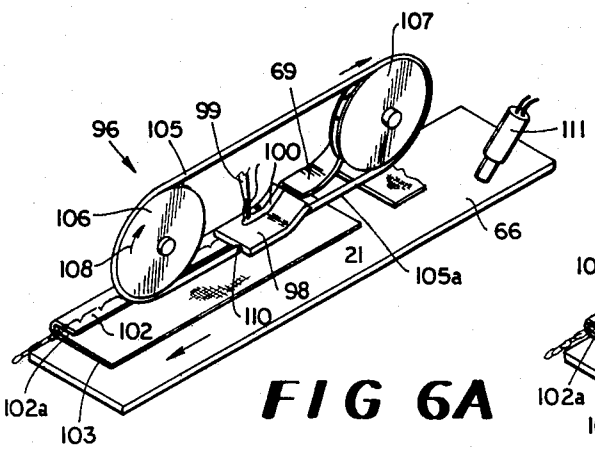

As illustrated in FIGS. 6A and 6B, a cloth section control system 96 is located adjacent sewing machines 68 and 79 for the purpose of controlling the movement of the cloth section to the folder and sewing machine. The conveyor tapes 65 and 66 are driven at a constant speed and the sewing machines 68 and 79 also function at a constant speed. As the edge portion of a cloth section 21 moves through folder 69, it is folded over onto itself, and the fold moves beneath the presser foot 98 of the sewing machine, where the needle 99 sews through the slot 100 in the presser foot. The feed dogs 101 reciprocate in the normal arrangement to continually pull the hem 102 on through the sewing machine, and the conveyor tapes 65 and 66 move at a velocity substantially equal to the velocity of the hem 102.

As the edge portion of the cloth moves through the stationary folder 69, the friction between the cloth and the folder tends to slightly retard the folded over portion of the hem 102, so that the leading end 102*a* of the folded over portion of the cloth section is slightly displaced from the leading edge 103 of the cloth section. An endless band 105 extends about a pair of sheaves 106 and 107, and sheave 106 is driven in the direction indicated by arrow 108 by a motor and variable speed transmission (not shown). A groove 110 is formed in the bottom surface of presser foot 98, and the band 105 moves from the lower surface of sheave 107 in a slight downward incline to the bottom surface of presser foot 98, where the groove 110 in the presser foot guides the band on beneath the presser foot. The band is subsequently picked up by the sheave 106. The sheaves 106 and 107 and the groove 110 in the presser foot are located so that the lower flight 105*a* of the band 105 is placed down on the moving cloth section 21 adjacent the fold 102 being formed in the cloth. Photoelectric cell 111 is located adjacent sheave 107 and functions to detect the trailing edge of a cloth section as each section moves into the sewing machine. Photoelectric cell 111 is operably connected to the variable speed transmission which drives sheave 106, and the arrangement is such that the driven sheave 106 slows down in response to the detection of a trailing edge portion of a cloth section by the photoelectric cell 111. This causes the velocity of the band 105 to decrease, and since the lower flight of the band engages the portion of the cloth section adjacent the hem of the cloth section, the velocity of that portion of the cloth section adjacent its fold 102 decreases. In the meantime, the feed dogs 101 of the sewing machine are continuing to urge the fold 102 on through the sewing machine at a constant velocity. This causes the portion of the trailing edge of the cloth section to be pulled or stretched adjacent the fold 102. Thus, the friction exerted by the folder 69 on the folded over portion of the hem which normally retards the movement of the folded over portion of the hem and the rearward stretching of the cloth section adjacent the fold causes the trailing edge of the folded over portion of the hem to be substantially aligned with the trailing edge of the body portion of the cloth section. This reduces the likelihood of a "dog ear" or "hangout" from occurring at the trailing edge of the cloth section.

A similar control system 96 is positioned adjacent both sewing machines 68 and 79 so that both cut edges of the cloth sections are properly formed.

Figure 5B:
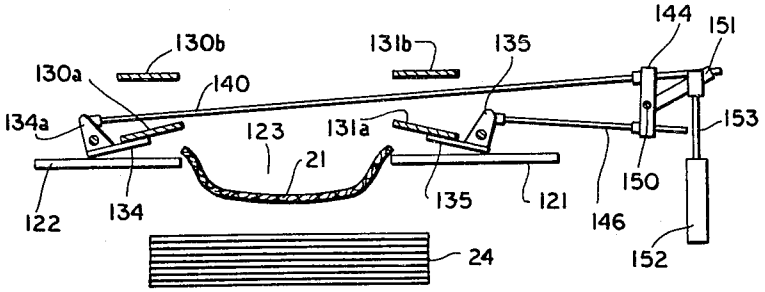
FIGS. 5A and 5B are end cross-sectional views of the stacker.
Figure 5A:
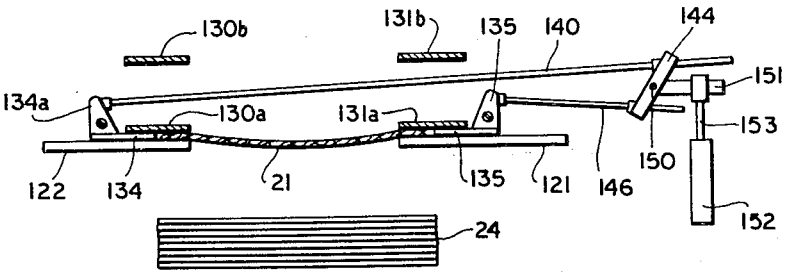
Figure 4:
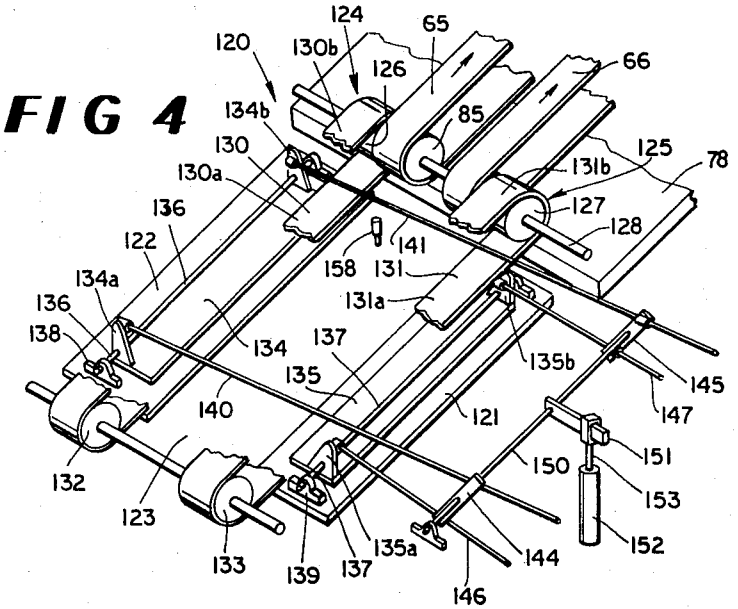
FIG. 4 is a perspective illustration of the stacker.

As illustrated in FIG. 4, a stacker 120 is located at the end of work table 78 and includes a pair of elongated, spaced, parallel conveyor surfaces 121 and 122 which are coextensive with the upper surface of work table 78 and which define an open space therebetween. A pair of endless conveyor belt assemblies 124 and 125 each include rollers 126 and 127 which are mounted on a shaft 128 that is common with the rollers 85 and 86 of conveyor tapes 65 and 66. Endless conveyor tapes 130 and 131 extend from their respective rollers 126 and 127 about rollers 132 and 133, forming lower flights 130*a* and 131*a* and upper flights 130*b* and 131*b*. Lower flights 130*a* and 131*a* move in contact with the conveyor surfaces 121 and 122. Tilting plates 134 and 135 are located on conveyor surfaces 121 and 122. The plates 134 and 135 have upstanding levers 134*a* and 134*b*, and 135*a* and 135*b* at their ends, respectively, and pivot pins 136 and 137 extend through the levers and are mounted at their ends in bearings 138 and 139. Push rods 140 and 141 are connected to the levers 134*a* and 134*b* and to the upper ends of oscillating links 144 and 145. Pull rods 146 and 147 are each connected at one of their ends to levers 135*a* and 135*b*, respectively, and at their other ends to the lower ends of oscillating links 144. Connecting rod 150 is rigidly connected at its ends to each of the oscillating links 144 and 145, and lever 151 is rigidly connected to the connecting rod 150. Fluid actuated ram 152 has its rod 153 connected to the lever 151. The connecting rod 150 is mounted in bearings at its ends, so that when the rod 153 of ram 152 is distended, the oscillating links 144 and 145 will move in a counterclockwise direction and push push rods 140 and 141 and pull pull rods 146 and 147, causing the tilt plates 134 and 135 to tilt from their horizontal attitudes as illustrated in FIG. 5A to an upwardly inclined attitude as illustrated in FIG. 5B. This causes the lower flights 130*a* and 131*a* of the conveyor tapes to tilt upwardly away from the conveyor surfaces 121 and 122.

When a finished cloth section 21 moves into stacker 120, the lower flights 130*a* and 131*a* of the conveyor tapes 130 and 131 continue the lateral movement of the cloth section from the surface of second work table 78 out onto the spaced parallel conveyor surfaces 121 and 122 (FIG. 5A). When photoelectric cell 158 detects the presence of the trailing edge of the cloth section it actuates ram 152. The ram 152 and the linkage system of the stacker tilts the tilt plates 134 and 135 upwardly (FIG. 5B) so that the conveyor tapes release the side edges of the cloth section and the cloth section drops through the open space 123 to form a stack of finished cloth sections.

While this invention has been described in detail with particular reference to preferred embodiments thereof, it will be understood that variations and modifications can be effected within the spirit and scope of the invention as described hereinbefore and as defined in the appended claims.

I claim:

1. Apparatus for forming hemmed sections of cloth and the like comprising first feed means for pulling a length of cloth along its length from a supply, guide means for guiding the length of cloth in a first direction with one surface facing up and subsequently in a second direction with the opposite surface facing up, a first edge treating means positioned along the path of the length of cloth as the cloth moves in the first direction, a second edge treating means positioned along the path of the length of cloth as the cloth moves in the opposite direction, second feed means for moving the length of cloth to a cutting station, cutting means in said cutting station for cutting sections of cloth from the length of cloth, a belt conveyor system including a belt conveyor for receiving and moving the sections of cloth in sequence from said cutting station along the first and second legs of an approximately L-shaped path with the cut edges of the sections of cloth extending along the path of movement, a third edge treating means positioned along the first leg of the L-shaped path and arranged to treat one cut edge of the sections of cloth, and a fourth edge treating means positioned along the second leg of the L-shaped path and arranged to treat the other cut edge of the sections of cloth, and an elongated convex turning member positioned at the intersection of the first and second legs of the L-shaped path of said belt conveyor system with the longitudinal axis of said turning member oriented at an approximately 45° angle with respect to the first and second legs of the L-shaped path, with said belt conveyor extending about said turning member.

2. The apparatus of claim 1 and wherein said elongated convex turning member comprises an elongated rectangular guide sheet twisted along its length through an approximately 90° turn to form a convex turning surface, said guide sheet including one edge portion positioned over the belt conveyor with the belt conveyor extending about the convex surface of said turning member.

3. The apparatus of claim 1 and further including stacking means positioned at the end of the second leg of the L-shaped path of said belt conveyor system for receiving and stacking the sections of cloth.

4. The apparatus of claim 1 and further including stacking means positioned at the end of the second leg of the L-shaped path of said belt conveyor system and including means grasping the side edge portions of the sections of cloth and carrying the sections of cloth beyond said belt conveyor and releasing the sections of cloth.

* * * * *